US009653846B1

(12) United States Patent
Caldwell et al.

(10) Patent No.: US 9,653,846 B1
(45) Date of Patent: May 16, 2017

(54) CONNECTOR ASSEMBLY WITH POSITIONAL ASSURANCE

(71) Applicant: DELPHI TECHNOLOGIES, INC., Troy, MI (US)

(72) Inventors: Bart N. Caldwell, West Farmington, OH (US); Kevin S. Turner, Cortland, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 15/177,763

(22) Filed: Jun. 9, 2016

(51) Int. Cl.
*H01R 13/641* (2006.01)
*H01R 13/629* (2006.01)
*H01R 13/422* (2006.01)
*H01R 43/26* (2006.01)

(52) U.S. Cl.
CPC ... *H01R 13/62955* (2013.01); *H01R 13/4226* (2013.01); *H01R 43/26* (2013.01)

(58) Field of Classification Search
CPC ..... H01R 13/6272; H01R 13/641; H01R 13/6275
USPC ..... 439/352, 489
See application file for complete search history.

(56) References Cited

U.S. PATENT DOCUMENTS 6,004,153 A * 12/1999 Myer ..... H01R 13/641 439/352
6,068,507 A * 5/2000 Popa ..... H01R 13/641 439/352
8,628,344 B2 * 1/2014 Cole ..... H01R 13/6272 439/352
8,784,127 B2 7/2014 Bashkin et al.
9,054,458 B1 * 6/2015 Ng ..... H01R 13/641
9,054,459 B2 * 6/2015 Guillanton ..... H01R 13/5202
9,142,919 B2 * 9/2015 Osada ..... H01R 13/6272
9,397,445 B1 * 7/2016 Roman ..... H01R 13/639
9,478,906 B2 * 10/2016 Myer ..... H01R 13/6273
2002/0115332 A1 * 8/2002 Myer ..... H01R 13/641 439/352
2003/0157825 A1 * 8/2003 Kane ..... H01R 13/641 439/352
2007/0161284 A1 * 7/2007 Tyler ..... H01R 13/6272 439/489

(Continued)

OTHER PUBLICATIONS

Delphi 150, 280 & 630 Series GT Connection Systems Brochure, Delphi Corporation, 2008.

*Primary Examiner* — Gary Paumen
(74) *Attorney, Agent, or Firm* — Robert J. Myers

(57) ABSTRACT

A connector assembly includes a first connector that includes a ramp. A second connector has a pump handle that includes laterally spaced legs joined at a hook. The hook is configured to interlock with the ramp in an intermediate assembled condition that provides continuity between the first and second connectors. The pump handle has a lower surface. A positional assurance element is movably supported on the second connector and includes a tongue that is arranged between the legs. The tongue includes an upper surface that extends beyond the lower surface such that the tongue and the pump handle overlap one another with the first and second connectors in a nested but unassembled condition. The positional assurance element is configured to move from a retracted position to an extended position while in the intermediate assembled condition to provide a fully assembled condition.

20 Claims, 5 Drawing Sheets

(56) References Cited

U.S. PATENT DOCUMENTS

| | | | | |
|---|---|---|---|---|
| 2009/0298320 | A1* | 12/2009 | Schmitt | H01R 13/6275 439/352 |
| 2014/0004732 | A1* | 1/2014 | Heil | H01R 13/6275 439/352 |
| 2015/0222055 | A1* | 8/2015 | Plazio | H01R 13/641 439/347 |
| 2016/0072226 | A1* | 3/2016 | Puhl | H01R 13/6273 439/352 |

* cited by examiner

CONNECTOR ASSEMBLY WITH POSITIONAL ASSURANCE

TECHNICAL FIELD OF THE INVENTION

This disclosure relates to a connector assembly that may be used, for example, for making an electrical connection. More particularly, the disclosure relates to a connector assembly with a positional assurance element.

BACKGROUND OF THE INVENTION

A typical connector assembly includes male and female connectors that are secured to one another in a snap-fit relationship to make an electrical connection, for example. Some connector assemblies also use a positional assurance element to provide feedback that the connectors are fully engaged with one another. This is particularly useful in applications where it is difficult to make the connection due to limited or awkward access and visual confirmation is problematic.

One type of positional assurance element is provided by a structure that is slidably supported on one of the male and female connectors. The positional assurance element includes a tongue arranged between laterally spaced apart legs of a pump handle that also includes a hook which joins the legs. As the connectors are pushed fully into engagement with one another, the hook snaps onto a ramp of the adjacent connector. The tongue also slides upward along the shroud, which releases a tongue lock from its supporting connector. Otherwise, the lock will prevent the positional assurance element from being moved. But, once the connectors are snap-fit to one another and fully engaged in an intermediated assembled condition, the positional assurance element can be slid from a retracted position to an extended position.

If the connectors are not fully engaged with one another, the operator will not be able to move the positional assurance element to the extended position, which indicates that the connectors are not fully engaged. Occasionally, the operator may also believe the connectors are not fully engaged—even when the connectors are, in fact, fully engaged—due to a failure of the positional assurance element, which prevents its movement to the extended position.

The connectors have some clearance between one another so the connectors do not have to be precisely aligned, which better enables blind assembly or assembly in tight spaces. This clearance permits the connectors to be laterally misaligned before being pushed together during assembly. Current positional assurance elements and pump handles are designed such that an upper surface of the tongue is arranged below a lower surface of the legs. If the connectors are not closely aligned with one another during connector assembly, the tongue may be pushed laterally underneath the pump handle and plastically deformed or broken, which may prevent the positional assurance element from being slid to the extended position during final assembly of the connector.

What is needed is a more robust connector assembly with positional assurance.

BRIEF SUMMARY OF THE INVENTION

In accordance with an embodiment of the invention, a connector assembly is provided. The connector assembly includes a first connector that includes a ramp, a second connector that has a pump handle that includes laterally spaced legs joined at a hook. The hook is configured to interlock with the ramp in an intermediate assembled condition that provides continuity between the first and second connectors. The pump handle has a lower surface. The connector assembly further includes a positional assurance element that is movably supported on the second connector and includes a tongue arranged between the legs. The tongue includes an upper surface that extends beyond the lower surface such that the tongue and the pump handle overlap one another with the first and second connectors in an unassembled condition. The positional assurance element is configured to move from a retracted position to an extended position while in the intermediate assembled condition to provide a fully assembled condition. The first and second connectors may be respectively female and male connectors.

The second connector may provide spaced apart tracks and the positional assurance element may include guides that straddle the tracks. The positional assurance element may be configured to slide along the tracks from the extended position to the retracted position. The pump handle may include an end and the positional assurance element may include a face. The face and the end may be spaced apart from one another in the retracted position, and the face and the end may be in abutment with one another in the extended position.

The positional assurance element may include a clip that cooperates with the pump handle in the retracted position to retain the positional assurance element on the second connector. The first connector may provide a shroud and the tongue may include a tapered nose that engages the shroud when moving from an unassembled condition to the intermediate assembled condition. The legs may each include a rail provided on opposing sides of the tongue and having the lower surface, the rails may be configured to capture the tongue during displacement. The rails may overlap the tongue in the unassembled condition. The rails may overlap the tongue in the intermediate assembled condition and in the retracted position.

The positional assurance element may include a lock that cooperates with a stop provided on a shroud of the second connector in the retracted position to prevent movement of the positional assurance element to the extended position.

In accordance with an embodiment of the invention, a method of connector assembly is provided. The method includes the step of pushing the first and second connectors together with a positional assurance element in a retracted position. The pushing step causes the steps of deflecting a pump handle with the first connector, laterally retaining a tongue of the positional assurance element with the pump handle while deflecting the tongue with the first connector, and interlocking the pump handle to the first connector to provide an intermediate assembled condition. The method further includes the step of moving the positional assurance element to an extended position to provide a fully assembled condition.

The method may further include the steps of snapping the positional assurance element into the second connector to arranged a lock on the tongue into abutment with a stop on the second connector and releasing the lock from the stop when tongue slides onto the first connector with the first and second connectors in the intermediate assembled condition.

The pump handle may include laterally spaced legs joined at a hook. The hook may slide onto the first connector during the deflecting step. The tongue may slide onto the first connector during the laterally retaining step.

The first connector may include a ramp, and the interlocking step may include interlocking the ramp and the hook. The laterally retaining step may include laterally retaining the tongue with the legs. The tongue may slide onto the first connector prior to performing the interlocking step.

The tongue and the legs may be in an overlapping relationship with one another prior to and during the pushing step. The moving step may include sliding the positional assurance element along the second connector until a face of the positional assurance element abuts an end of the pump handle.

BRIEF DESCRIPTION OF THE SEVERAL VIEWS OF THE DRAWING

The disclosure can be further understood by reference to the following detailed description when considered in connection with the accompanying drawings wherein.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

DETAILED DESCRIPTION OF THE INVENTION

Figure 1:
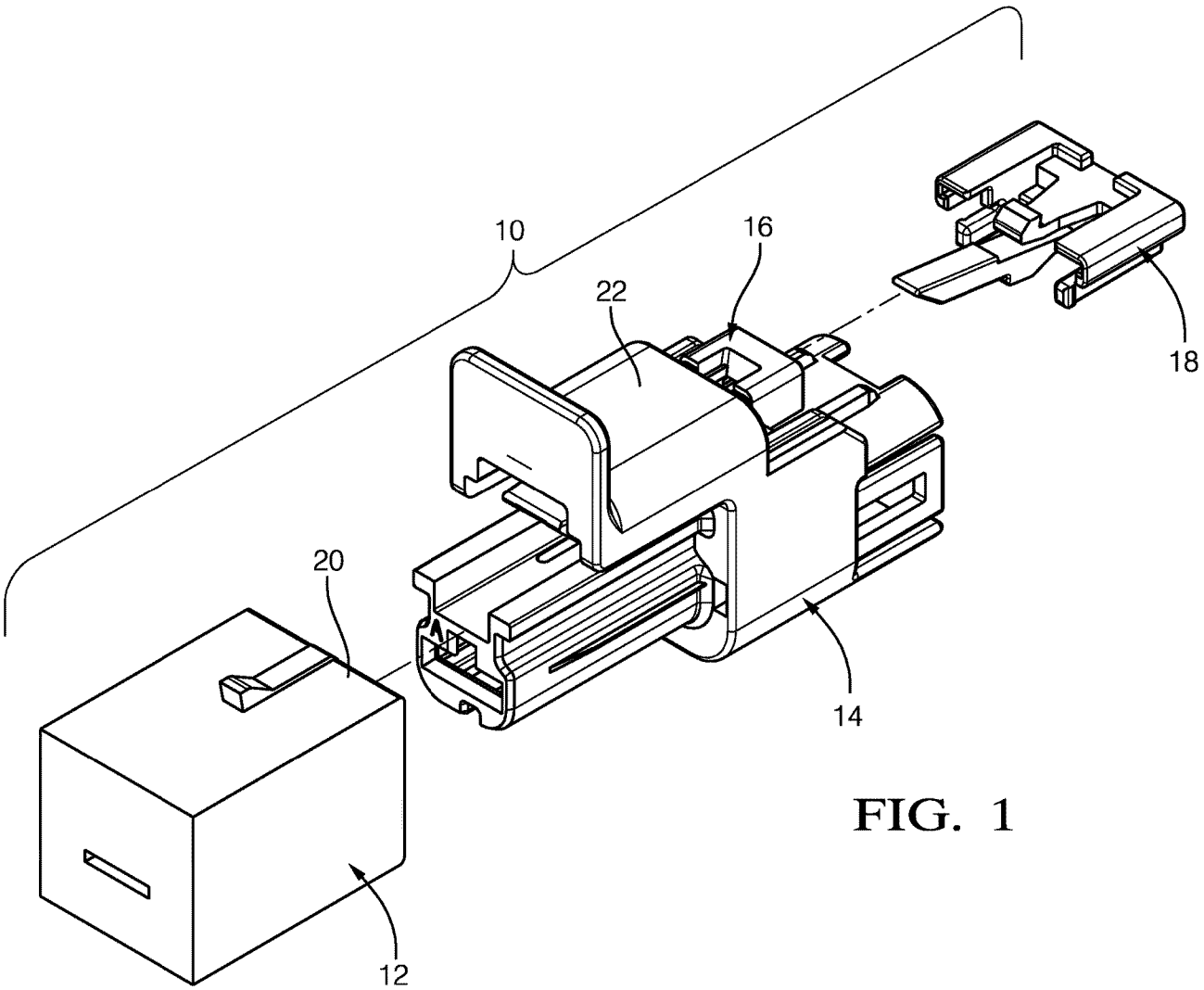
FIG. 1 is an exploded view of a connector assembly with a positional assurance element.
Figure 2:
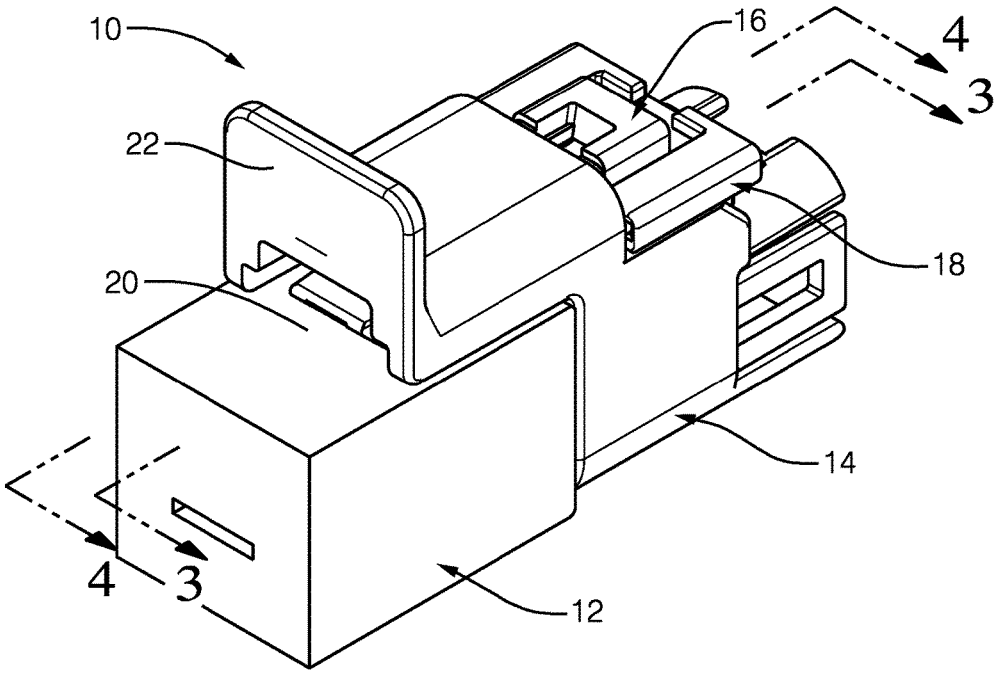
FIG. 2 is a perspective view of the connector assembly in a fully assembled condition.

Referring to FIGS. 1 and 2, a connector assembly 10 is shown having first and second connectors 12, 14, which respectively correspond to female and male connectors. A pump handle 16 is provided on the second connector 14 for positively securing the first and second connectors with respect to one another. A positional assurance element 18 is also provided on the second connector 14 to provide confirmation and visual feedback as to when a full and complete connection between the first and second connectors 12, 14 has been made. That is, the positional assurance element 18 cannot be actuated by the operator unless and until the first and second connectors 12, 14 are fully engaged with one another thereby making the desired connection.

Figure 3:
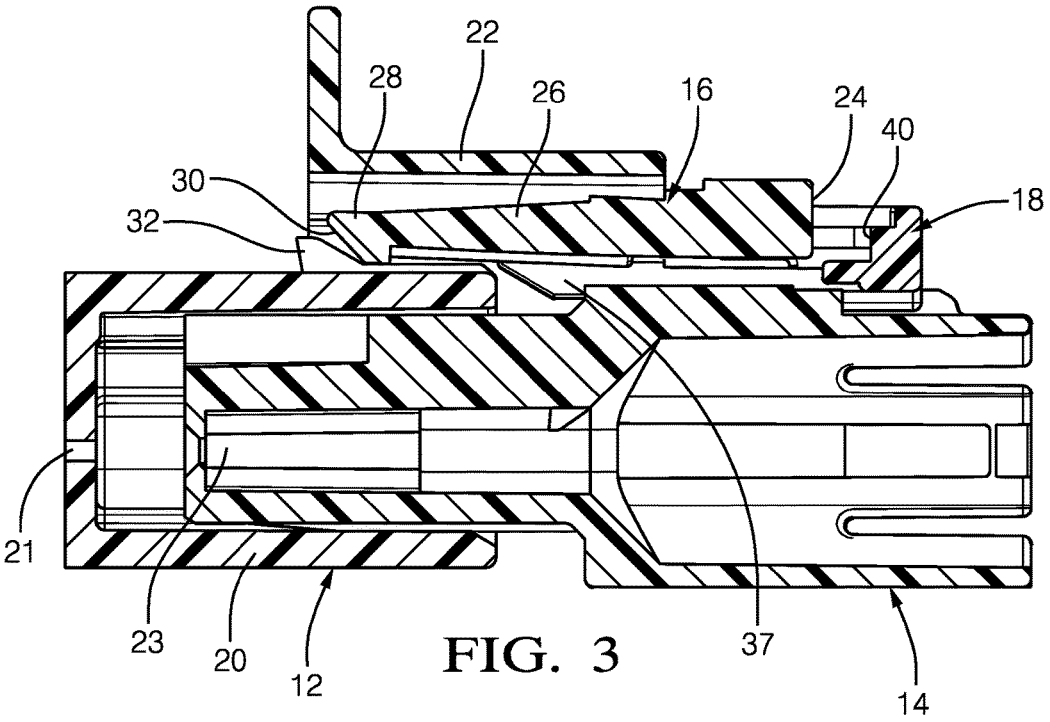
FIG. 3 is a cross-sectional view taken along line 3-3 in FIG. 2 with male and female connectors nested relative to one another and prior to achieving an intermediate assembled condition.

The first and second connectors 12, 14 respectively include first and second shrouds 20, 22, which respectively provide first and second regions 21, 23, as shown in FIG. 3. The first and second regions 21, 23 carry communicative elements (not shown) that are coupled to one another by connecting the first and second connectors 12, 14. In one example, the communicative elements are electrical wires with terminals that mate with one another. However, it should be understood that the communicative elements may also be fluid conduits, fiber optics, or other elements in need of connection.

Figure 4:
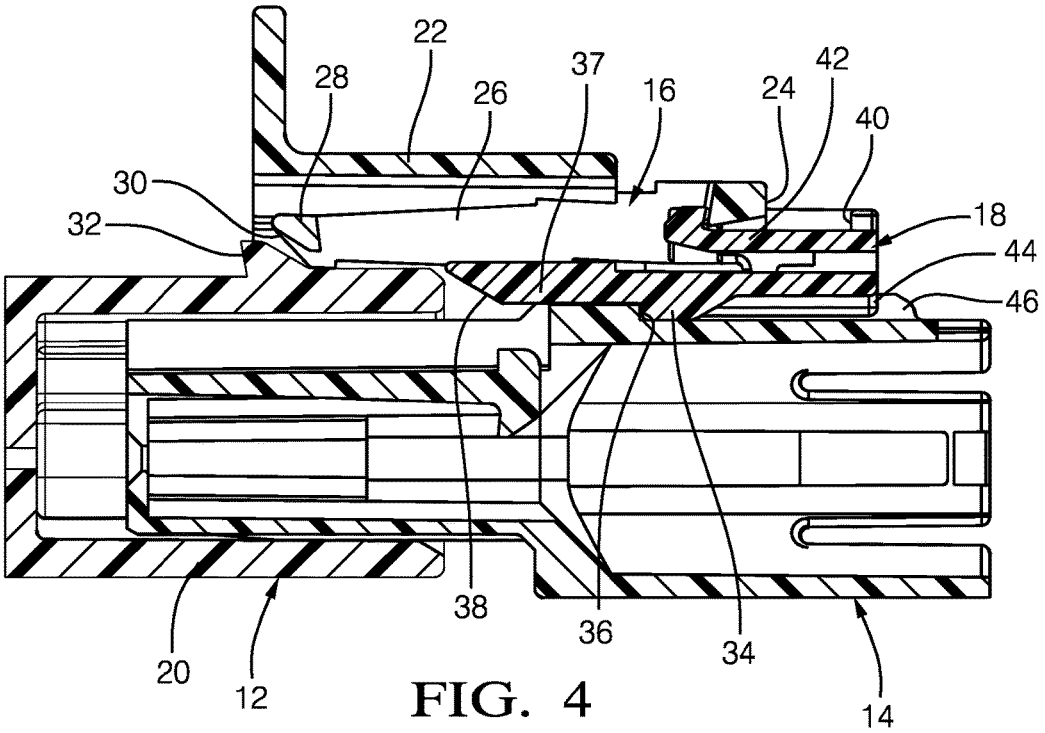
FIG. 4 is a cross-sectional view taken along line 4-4 in FIG. 2 and in a position similar to that of FIG. 3.

The positional assurance element 18 is illustrated in a retracted position in FIGS. 3 and 4. Tracks 46 are provided on the second shroud 22. Guides 44 downwardly from the positional assurance element 18 and are provided on either side of the spaced apart tracks 46. A clip 42 on the positional assurance element 18 engages with an end 24 of the pump handle 16 so the positional assurance element 18 is carried by the second shroud 22.

Figure 7:
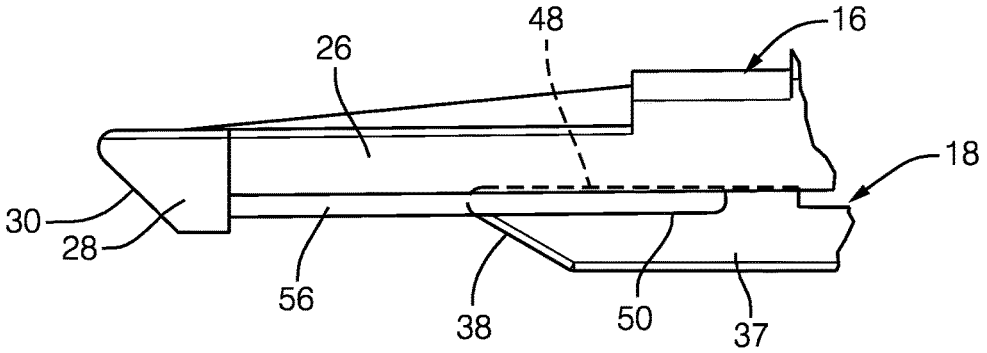
FIG. 7 is a side view of the pump handle and a tongue of the positional assurance element in a relaxed state.
Figure 8:
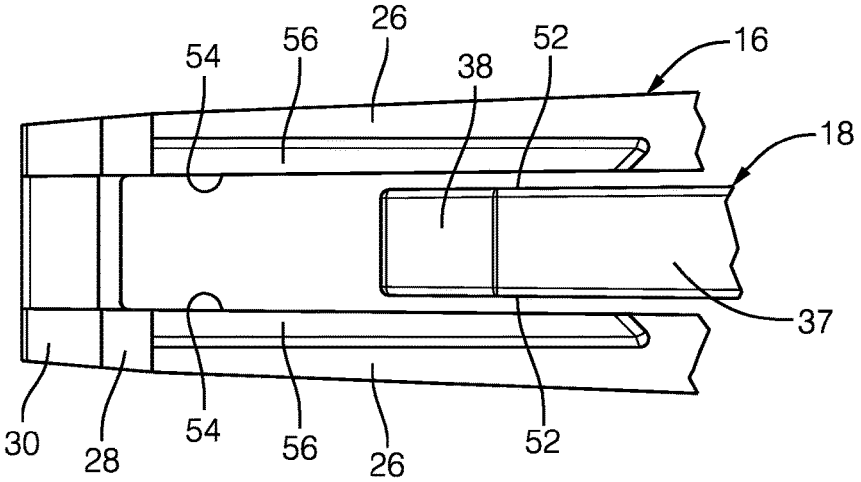
FIG. 8 is a bottom view of the pump handle and tongue shown in FIG. 7.
Figure 10:
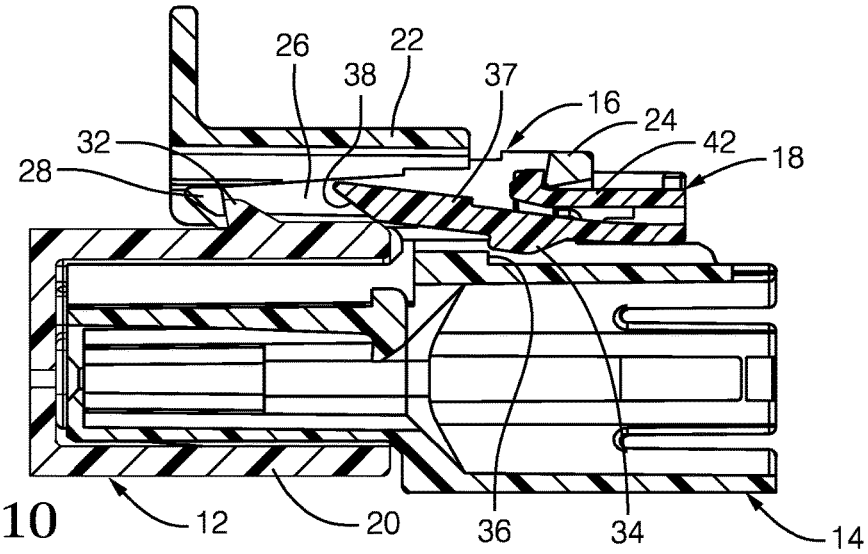
FIG. 10 is a cross-sectional view similar to that of FIG. 4 but with the male and female connectors in the intermediate assembled condition and the positional assurance element in a the retracted position.
Figure 12:
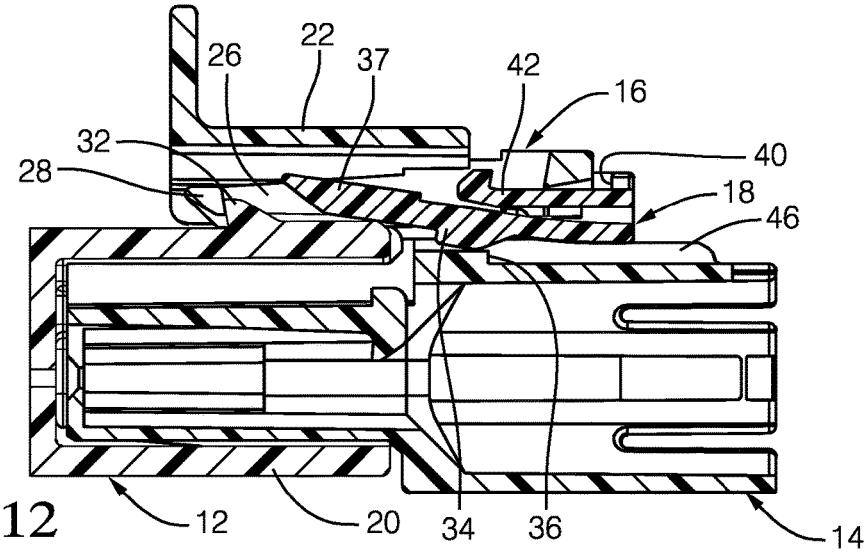
FIG. 12 is a cross-sectional view similar to that of FIG. 4 but with the male and female connectors in a fully assembled condition and the positional assurance element in an the extended position.

Referring to FIGS. 3 and 4 in conjunction with FIGS. 7 and 8, the pump handle 16 includes laterally spaced apart legs 26 extending from the end 24 and joined at a hook 28 opposite the end 24. The hook 28 provides a tapered surface 30 that engages a ramp 32 (FIG. 4) provided on the first connector 12 during assembly to lock the first and second connectors 12, 14 to one another (FIGS. 10 and 12). As best shown in FIG. 8, a tongue 37 of the positional assurance element 18 is provided laterally between the legs 26.

The first and second connectors 12, 14 are shown in a preassembly condition in FIGS. 3 and 4 in which the first and second connectors 12, 14 are nested with respect to one another in an unassembled condition with the connection not yet made. In this position, the hook 28 is arranged at an exterior of the first shroud 20 adjacent to the ramp 32, and a tapered nose 38 of the tongue 37 has not yet engaged the first shroud 20.

Returning to FIGS. 7 and 8, a rail 56 is provided on each leg 26 at an interior surface 54 that faces sides 52 of the tongue 37. In the example, the rails 56 are less than the width of the legs 26 (FIG. 8) and extend downward a distance that is less than the distance the hook 28 depend from the legs 26 (FIG. 7). Thus, the rails 56 strengthen the legs 26 of the pump handle 16 without the pump handle becoming too rigid.

An upper surface 48 of the tongue 37 extends above a lower surface 50 of the pump handle 16 when in the relaxed state. As a result, the pump handle 16 and the tongue 37 overlap one another, as indicated by the dashed line in FIG. 7, which prevents the tongue 37 from deflecting laterally more than the clearance provided between the tongue 37 and the rails 56. The pump handle 16 and positional assurance element 18 cooperate with one another throughout assembly to prevent a failure of the positional assurance element 18. The containment rails 56 encapsulate the tapered nose 38 of the tongue 37 such that the tongue 37 cannot become dislocated during assembly. The rails 56 provide a bearing surface for the tongue 37 in the relaxed state (FIGS. 5 and 6) and through to final assembly (FIGS. 11 and 12), which eliminates excessive side motion of the tongue 37 that could otherwise lead to failure.

Figure 5:
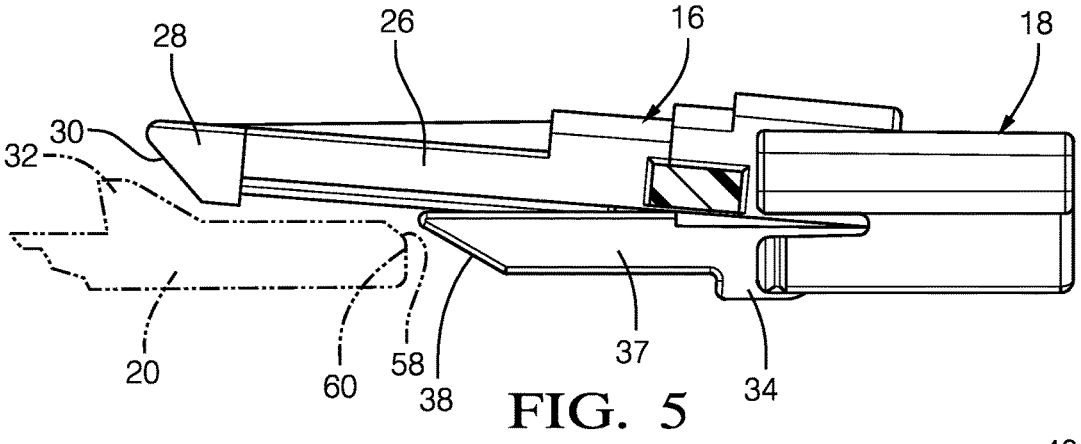
FIG. 5 is an enlarged side view of the positional assurance element with a pump handle shown in a deflected position.
Figure 6:
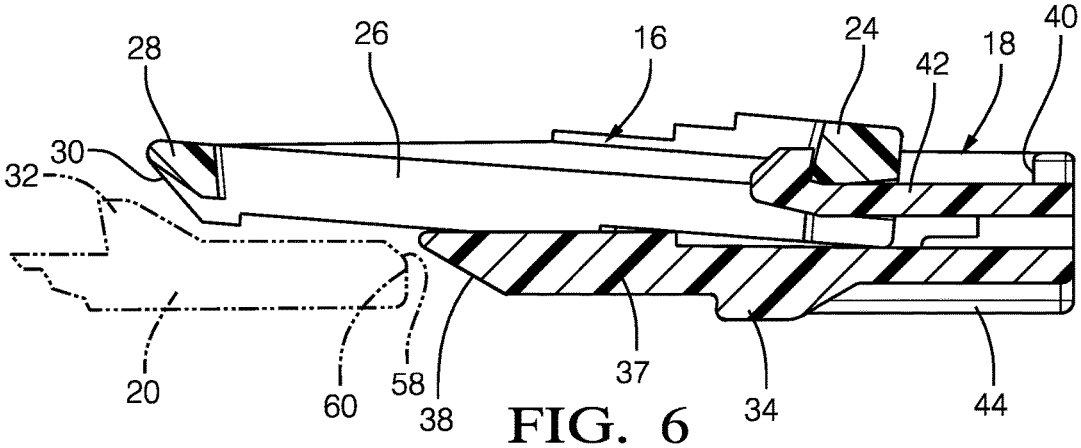
FIG. 6 is an enlarged cross-sectional view of the positional assurance element shown in FIG. 5 cooperating with the pump handle.
Figure 9:
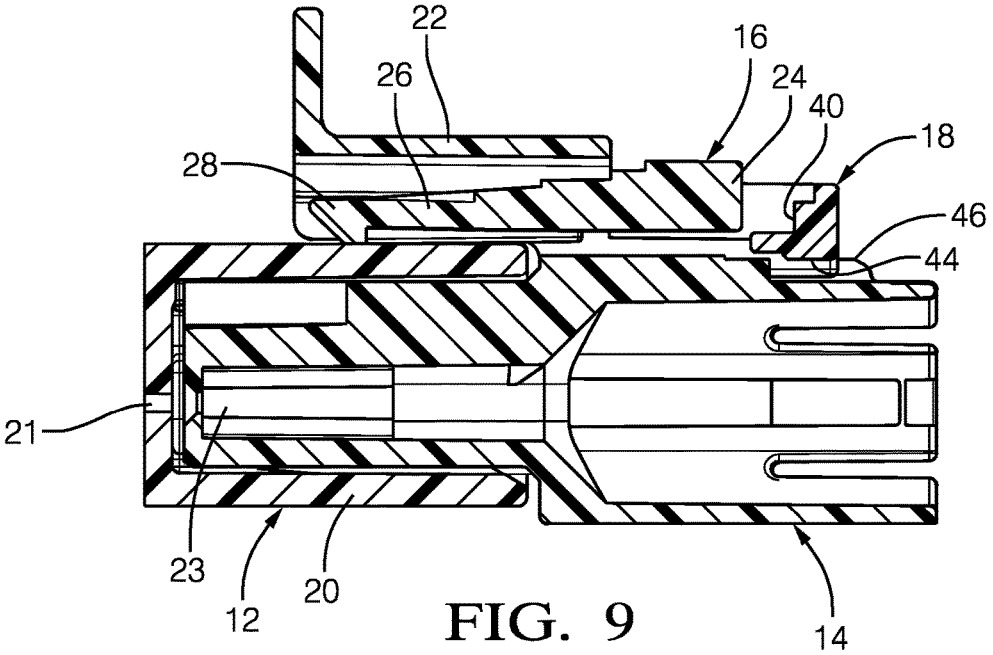
FIG. 9 is a cross-sectional view similar to that of FIG. 3 but with the male and female connectors in the intermediate assembled condition and the positional assurance element in a retracted position.
Figure 11:
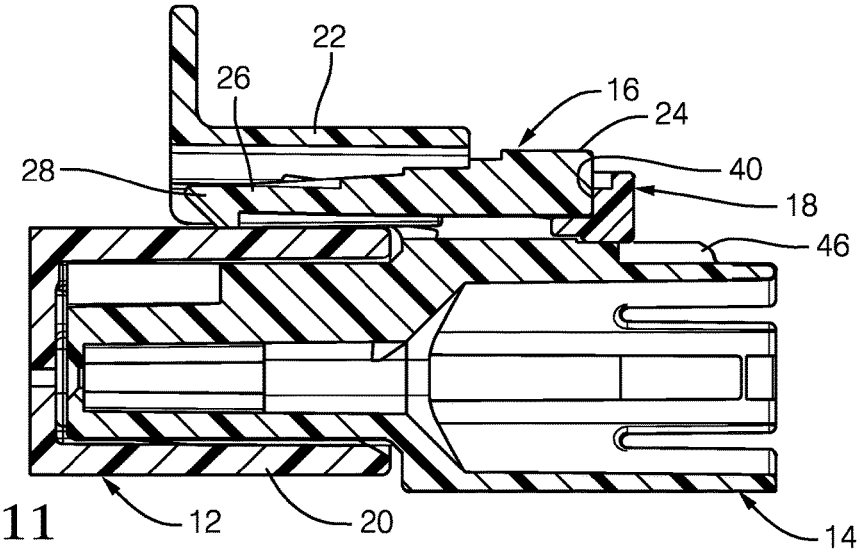
FIG. 11 is a cross-sectional view similar to that of FIG. 3 but with the male and female connectors in a fully assembled condition and the positional assurance element in an extended position.

In the relaxed state illustrated in FIGS. 3 and 4, a lock 34 is provided on an underside of the tongue 37 and abuts a stop 36, which prevents the positional assurance element 18 from being slid from the retracted position (FIGS. 3 and 4) to an extended position (FIGS. 11 and 12). Once the first and second connectors 12, 14 are pushed into further engagement with one another, the hook 28 will interlock with the ramp 32, as illustrated in FIGS. 9 and 10. In this position, the nose 38 of the tongue 37 will have slid onto a chamfered surface 58 of a front edge 60 of the first shroud 20, as shown in FIGS. 5 and 6. In this position, the tongue 37 is deflected upward, which releases the lock 34 from the stop 36, as shown in FIGS. 9 and 10. With the hook 28 interlocked with the ramp 32 and the lock 34 released, an intermediate assembled condition is obtained.

To complete assembly and confirm that the first and second connectors 12, 14 are fully engaged, the operator will then attempt to slide the positional assurance element 18 from the retracted position toward the first connector 12 to an extended position, as illustrated in FIGS. 11 and 12. If the operator succeeds in moving the positional assurance element 18 from the retracted position to the extended position, the guides 44 of the positional assurance element 18 will slide along the tracks 46 until a face 40 of the positional assurance element 18 abuts the end 24, which corresponds to the extended position. During this final assembly operation, the tongue 37 is captured within the pump handle 16. In this manner, positional assurance is provided that a full connection is provided and communicative continuity has been achieved between the first and second connectors 12, 14.

It should be understood that the terms "upper," "lower," "top," "bottom," "side," "up," "down" are used for convenience only and are in no way intended to be limiting. It should also be understood that although a particular component arrangement is disclosed in the illustrated embodiment, other arrangements will benefit herefrom. Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

Although an example embodiment has been disclosed, a person of ordinary skill in this art would recognize that certain modifications would come within the scope of the claims. For that reason, the following claims should be studied to determine their true scope and content.

We claim:

1. A connector assembly comprising:

a first connector that includes a ramp;

a second connector has a pump handle that includes laterally spaced legs joined at a hook, the hook is configured to interlock with the ramp in an intermediate assembled condition that provides continuity between the first and second connectors, the pump handle has a lower surface; and a positional assurance element is movably supported on the second connector and includes a tongue arranged between the legs, the tongue includes an upper surface that extends beyond the lower surface such that the tongue and the pump handle overlap one another with the first and second connectors in an unassembled condition, the positional assurance element is configured to move from a retracted position to an extended position while in the intermediate assembled condition to provide a fully assembled condition.

2. The connector assembly according to claim 1, wherein the first and second connectors are respectively female and male connectors.

3. The connector assembly according to claim 1, wherein the second connector provides spaced apart tracks, and the positional assurance element includes guides that straddle the tracks, the positional assurance element is configured to slide along the tracks from the extended position to the retracted position.

4. The connector assembly according to claim 3, wherein the pump handle includes an end, and the positional assurance element includes a face, the face and the end are spaced apart from one another in the retracted position, and the face and the end are in abutment with one another in the extended position.

5. The connector assembly according to claim 3, wherein the positional assurance element includes a clip that cooperates with the pump handle in the retracted position to retain the positional assurance element on the second connector.

6. The connector assembly according to claim 1, wherein the first connector provides a shroud, and the tongue includes a tapered nose that engages the shroud when moving from an unassembled condition to the intermediate assembled condition.

7. The connector assembly according to claim 1, wherein the legs each include a rail provided on opposing sides of the tongue and having the lower surface, the rail configured to capture the tongue during displacement.

8. The connector assembly according to claim 7, wherein the rail overlaps the tongue in the unassembled condition.

9. The connector assembly according to claim 8, wherein the rail overlaps the tongue in the intermediate assembled condition and in the retracted position.

10. The connector assembly according to claim 1, wherein the positional assurance element includes a lock that cooperates with a stop provided on a shroud of the second connector in the retracted position to prevent movement of the positional assurance element to the extended position.

11. A method of connector assembly comprising the steps of:

pushing first and second connectors together with a positional assurance element in a retracted position, the pushing step causing the steps of:

deflecting a pump handle with the first connector;

laterally retaining a tongue of the positional assurance element with the pump handle while deflecting the tongue with the first connector;

interlocking the pump handle to the first connector to provide an intermediate assembled condition; and moving the positional assurance element to an extended position to provide a fully assembled condition.

12. The method according to claim 11, comprising the step of snapping the positional assurance element into the second connector to arranged a lock on the tongue into abutment with a stop on the second connector.

13. The method according to claim 12, comprising the step of releasing the lock from the stop when tongue slides onto the first connector with the first and second connectors in the intermediate assembled condition.

14. The method according to claim 13, wherein the tongue slides onto the first connector during the laterally retaining step.

15. The method according to claim 11, wherein the pump handle includes laterally spaced legs joined at a hook, the hook slides onto the first connector during the deflecting step.

16. The method according to claim 15, wherein the first connector includes a ramp, and the interlocking step includes interlocking the ramp and the hook.

17. The method according to claim 13, wherein the laterally retaining step includes laterally retaining the tongue with the legs.

18. The method according to claim 17, wherein the tongue slides onto the first connector prior to performing the interlocking step.

19. The method according to claim 17, wherein the tongue and the legs are in overlapping relationship with one another prior to and during the pushing step.

20. The method according to claim 11, wherein the moving step includes sliding the positional assurance element along the second connector until a face of the positional assurance element abuts an end of the pump handle.

* * * * *